US006113293A

United States Patent [19]

Schanke et al.

[11] Patent Number: 6,113,293

[45] Date of Patent: Sep. 5, 2000

[54] LABEL PRINTER HAVING LEVER ACTUATED CUTTER

[75] Inventors: Robert L. Schanke, New Berlin; Brent A. Bandholz, West Allis, both of Wis.

[73] Assignee: Brady Worldwide, Inc., Milwaukee, Wis.

[21] Appl. No.: 09/085,990

[22] Filed: May 28, 1998

[51] Int. Cl.[7] ..... B41J 11/70

[52] U.S. Cl. ..... 400/621; 400/593; 101/93.07; 83/568; 83/628; 83/633; 83/694

[58] Field of Search ..... 400/621, 593; 101/288, 226, 93.07; 83/564, 568, 628, 633, 694

[56] References Cited

U.S. PATENT DOCUMENTS

| | | | |
|---|---|---|---|
| 3,861,280 | 1/1975 | Sato | 93/88 |
| 4,094,724 | 6/1978 | Sato | 156/384 |
| 4,126,983 | 11/1978 | Ito et al. | 53/593 |
| 4,211,498 | 7/1980 | Shimizu et al. | 400/621 |
| 4,253,905 | 3/1981 | Regan | 156/523 |
| 4,302,119 | 11/1981 | Siegenthaler | 400/621 |
| 4,312,597 | 1/1982 | Shimizu et al. | 400/621 |
| 4,406,730 | 9/1983 | Altmix | 156/574 |
| 4,552,610 | 11/1985 | Sato et al. | 156/384 |
| 4,826,551 | 5/1989 | Ingram | 156/186 |
| 4,840,696 | 6/1989 | Krasuski et al. | 156/353 |
| 4,852,329 | 8/1989 | Terragnoli | 53/399 |
| 4,990,213 | 2/1991 | Brown et al. | 156/425 |
| 5,063,803 | 11/1991 | Panneri et al. | 83/203 |
| 5,209,151 | 5/1993 | Takagi et al. | 83/564 |
| 5,224,786 | 7/1993 | Takagi et al. | 400/621 |
| 5,259,826 | 11/1993 | Woods | 493/325 |
| 5,271,789 | 12/1993 | Takagi et al. | 400/621 |
| 5,271,791 | 12/1993 | Tanaka | 156/468 |
| 5,441,352 | 8/1995 | Shiota | 400/621 |
| 5,482,389 | 1/1996 | Bickoff et al. | 400/621 |
| 5,518,576 | 5/1996 | Mendelovich et al. | 156/523 |
| 5,580,417 | 12/1996 | Bradshaw | 156/495 |
| 5,613,788 | 3/1997 | Dobring | 101/93.07 |
| 5,641,377 | 6/1997 | Chung et al. | 156/577 |
| 5,727,889 | 3/1998 | Koyabu | 400/621 |
| 5,746,527 | 5/1998 | Nebashi et al. | 400/621 |
| 5,971,639 | 10/1999 | Park | 400/621 |

FOREIGN PATENT DOCUMENTS

| | | | |
|---|---|---|---|
| 0 416 795 | 3/1991 | European Pat. Off. | G07B 1/00 |
| 2072583 | 10/1981 | United Kingdom | B65C 11/02 |

*Primary Examiner*—John S. Hilten
*Assistant Examiner*—Leslie J. Grohusky
*Attorney, Agent, or Firm*—Quarles & Brady LLP

[57] ABSTRACT

A cutting mechanism for a hand held printer includes a lever pivotally mounted to a base and coupled to a slidably mounted blade. Pivotal movement of the lever translates the blade along a cutting axis to cut labeling media. The lever is automatically returned to the noncutting position by a spring, and the blade is biased toward the cutting bar by a spring incorporated in the blade mounting mechanism. The blade has a chevron shape to provide a clean cut in a short cutting stroke.

3 Claims, 5 Drawing Sheets

LABEL PRINTER HAVING LEVER ACTUATED CUTTER

CROSS REFERENCES TO RELATED APPLICATIONS

Not applicable.

STATEMENT REGARDING FEDERALLY SPONSORED RESEARCH

Not applicable.

FIELD OF THE INVENTION

The present invention relates to a hand held printer, and more particularly to a labeling media cutting mechanism for a hand held thermal transfer printer.

DESCRIPTION OF THE BACKGROUND ART

There are a number of U.S. patents that disclose electronic apparatus for printing indicia on labels, some of these are restricted to hand held units and others that disclose tabletop units. Hand held labeling machines are disclosed, for example, in U.S. Pat. Nos. 4,264,396, Stewart; 4,407,692, Torbeck; 4,473,426, Goodwin et al.; 4,477,305, Hamisch; 4,490,206, Makely; 4,497,683, Hamisch; 4,498,947, Hamisch et al.; 4,511,422, Hamisch et al.; 4,544,434, Mistyurik; 4,556,442, Torbeck; 4,561,048, Hamisch et al.; and 4,680,078, Vanderpool et al. Tabletop units for this general purpose, some of which are portable are described in U.S. Pat. Nos. 4,440,248, Teraoka; 4,501,224, Shibayama; 4,630,538, Cushing; and 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a LED, LCD unit to assist the operator in using the machine. In a hand held printer, these components may all be enclosed in a single housing.

The labeling media comprises a series of labels that are attached to a carrier strip. The carrier strip is fed through the printer and legends are printed on the labels. The labels are then removed from the carrier and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a labeling media. By using digital technology, characters are formed by energizing a sequence of pixels on the print head which in turn melt the wax or other pigment on the ribbon transferring the image to the labeling media.

In a known thermal transfer printer such as a label printer, labeling media is fed by a paper feed roller simultaneously with a platen roller feeding an ink transfer ribbon. While the labeling media driven by the feed roller runs between the print head and the rotating platen roller, the transfer ribbon is passed between the print head and the platen roller by rotating the platen roller. As a result, the labeling media and the transfer ribbon pass together in overlay relationship between the print head and the platen roller.

Many prior art printers have various means and methods for separating printed labeling media from the unprinted labeling media. For example, U.S. Pat. No. 4,844,629, Hoyt, discloses a slot having a serrated edge that is used to tear the labeling media. A more complicated cutting mechanism, as disclosed in U.S. Pat. No. 5,078,523, McGourty et al, is composed of opposing cutting blades. In U.S. Pat. No. 5,078,523, an electric motor pivotally moves one blade across a fixed opposing blade to cut the labeling media.

These prior art means and methods are either too large for use in a hand held printer or require tearing the labeling media that tends to leave a torn jagged edge or may result in tearing a label requiring the operator to print a new label.

SUMMARY OF THE INVENTION

The present invention is an apparatus for cutting labeling media in a hand held label printer. The cutting apparatus includes a base; a blade slidably mounted to the base for movement along an axis between a noncutting position and an actuated position; a lever pivotally mounted to the base and coupled to the blade such that pivotal movement of the lever slides the blade between its noncutting position and its actuated position.

The general objective of the present invention is to provide a compact cutting mechanism suitable for hand held printers. By pivotally mounting a lever to a base and coupling the lever to a blade that is slidably mounted to the base for motion along the cutting axis, the lever stroke necessary to cut labeling media with the blade is reduced.

Another objective of the present invention is to cleanly cut the labeling media without leaving jagged edges. This is accomplished by providing a breaker bar mounted to the base that works cooperatively with the blade to cleanly cut the labeling media.

A further objective is to minimize the blade movement while optimizing the blade cutting angle. This is accomplished by providing a chevron shaped cutting edge on the blade, which reduces blade movement along the cutting axis while providing an optimal blade cutting angle.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
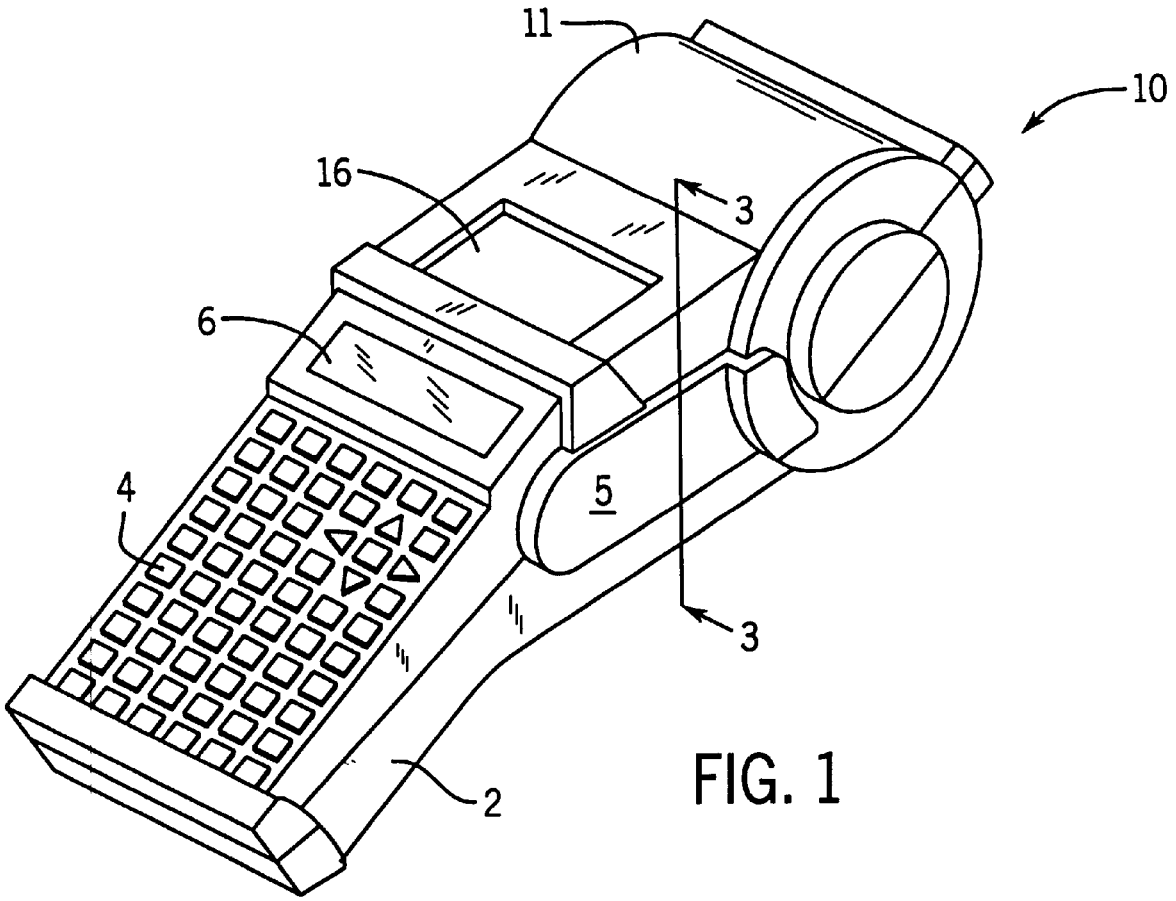
FIG. 1 is a perspective view of a hand held label printer which employs the present invention.
Figure 2:
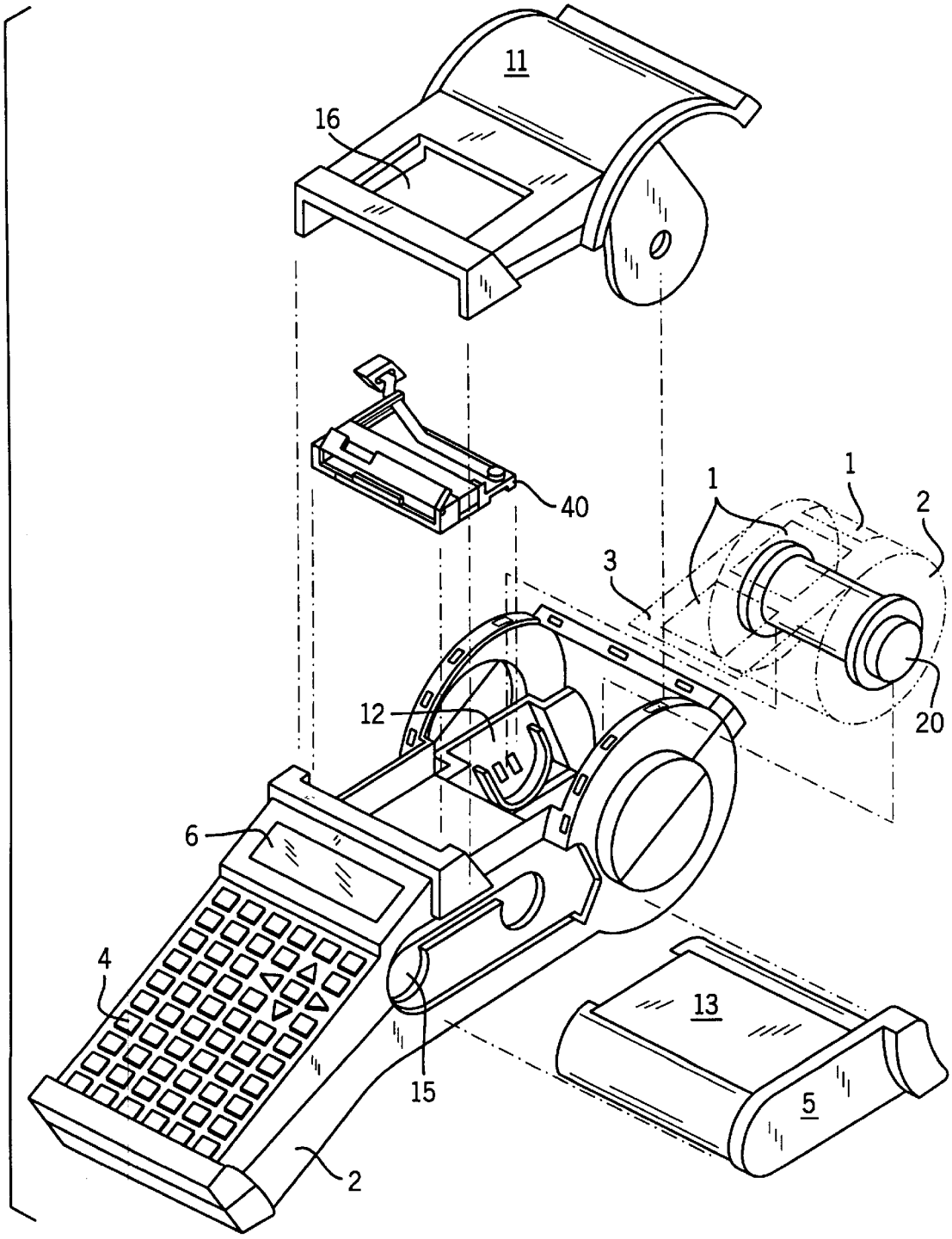
FIG. 2 is an exploded perspective view of the printer in FIG. 1.

Referring particularly to FIGS. 1 and 2, a thermal transfer printer 10 which employs the preferred embodiment of the present invention includes a molded plastic housing 2 that supports a keyboard 4 on its front surface and a display 6 positioned above the keyboard 4. A receptacle cavity 12 formed in the housing 2 above the display 6 receives a spool 20 containing labeling media 22. The labeling media 22 is formed as a roll which is carried by the spool 20. A cover 11 enclosing the spool 20 and labeling media 22 in the receptacle cavity 12 is pivotally attached to the housing 2.

The labeling media 22 is comprised of a carrier web 3 which supports a series of adhesive labels 1. The size, color, and type of label material carried by the spool 20 varies depending upon the particular print application. The labeling media 22 unrolls off the spool 20 as it is consumed by the printer 10.

Figure 3:
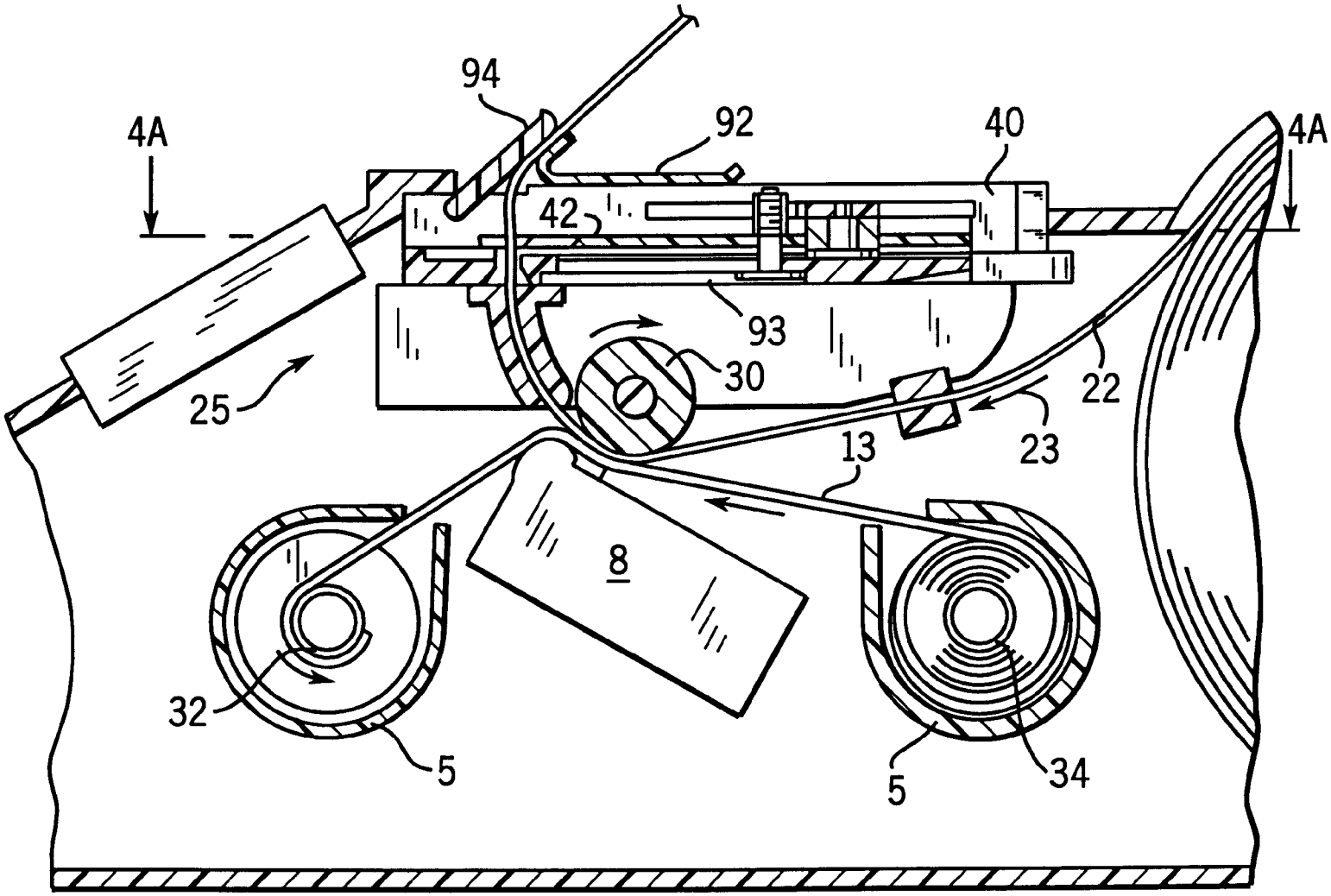
FIG. 3 is a section view of the printer in FIG. 1 showing the ink ribbon and labeling media path.

The spool 20 is inserted into the receptacle cavity 12 on the printer 10 and the labeling media 22 is threaded along a labeling media path 23, as shown in FIG. 3, in a printing mechanism 25 disposed within the housing 2. A print head 8 within the printing mechanism 25 disposed along the labeling media path 23 is arranged to cooperate with the thermal transfer ribbon 13 and the labeling media 22 such that the print head 8 can print characters or symbols on the labeling media 22. This is described in greater detail in U.S. Pat. No. 5,078,523 which is incorporated herein by reference.

More specifically, a cam mechanism (not shown) within the printer 10 urges the print head 8, as shown in FIG. 3, into close abutting relation with the labeling media 22 and ribbon 13 captured between a drive roller 30 and the print head 8. Circuitry in the printer 10 drives the drive roller 30 and a take up spool 32 to advance the labeling media 22 and ribbon 13. When a desired character is input by an operator or other means, the electronics of the printer 10 energizes pixels on the thermal transfer head 8 as the labeling media 22 and ribbon 13 advance past the head 8. The head pixels are variously energized to imprint the character on the labeling media 22. This is described in greater detail in U.S. Pat. No. 5,078,523 which has been incorporated herein by reference.

An ink ribbon cartridge 5, shown in FIGS. 2 and 3, having a thermal transfer ribbon 13 disposed within the cartridge 5 is inserted into a cavity 15 in the side of the printer housing 2 and received by the printing mechanism 25. The ribbon cartridge 5, shown in FIGS. 2 and 3, rotatably accommodates a supply spool 34 containing the ribbon 13 for thermal transfer printing onto a labeling media 22 and the take up spool 32 for taking up the inked ribbon 13 as it is used in the thermal transfer printing process. When the direction of ink ribbon 13 travel is reversed, the ink ribbon 13 is taken up by the supply spool 34 and ribbon 13 is unwound from the take up spool 32. The ink ribbon cartridge as used with this invention is fully described in copending patent application THERMAL TRANSFER RIBBON CARTRIDGE, application Ser. No. 09/033341 filed on Mar. 2, 1998 and incorporated by reference herein. The labeling media and ink ribbon are fed through the printing mechanism by a drive mechanism fully described in copending patent application, METHOD AND APPARATUS FOR MAINTAINING RIBBON TENSION, application Ser. No. 09/033342, filed on Mar. 2, 1998 now U.S. Pat. No. 5,951,177.

After printing, labeling media 22 advances to a "cut" position, at which time, the operator manually actuates a cutting mechanism 40 that separates the labeling media 22 containing the printed label 1 from the unused portion. As shown in FIG. 3, the cutting mechanism 40 is disposed above the printing mechanism 25 at the end of the labeling media path 23. Labeling media 22 fed into the cutting mechanism 40 is cut by a blade 42 disposed within the cutting mechanism 40. The cut position exposes the printed label 1 to the operator through an opening 16 in the housing. Once the operator actuates the cutting mechanism 40, the label 1 is retrieved by the operator for use.

Figure 4A:
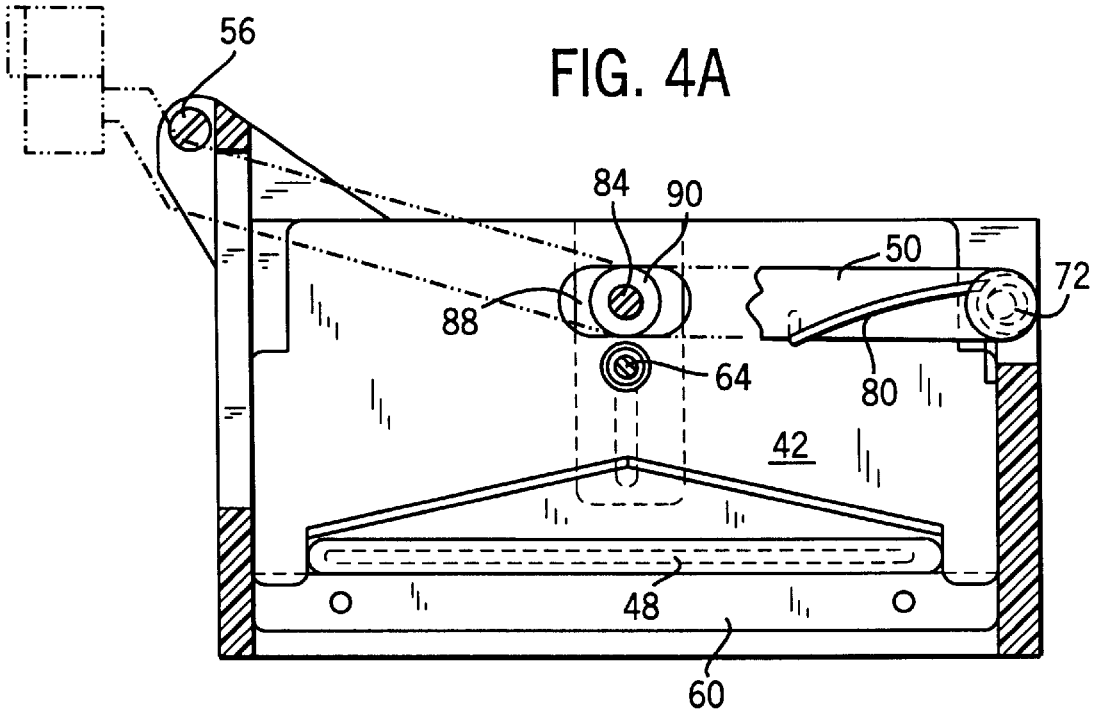
FIG. 4A is a plan view of the cutting mechanism which forms part of the printer of FIG. 2 in a noncutting position.
Figure 4B:
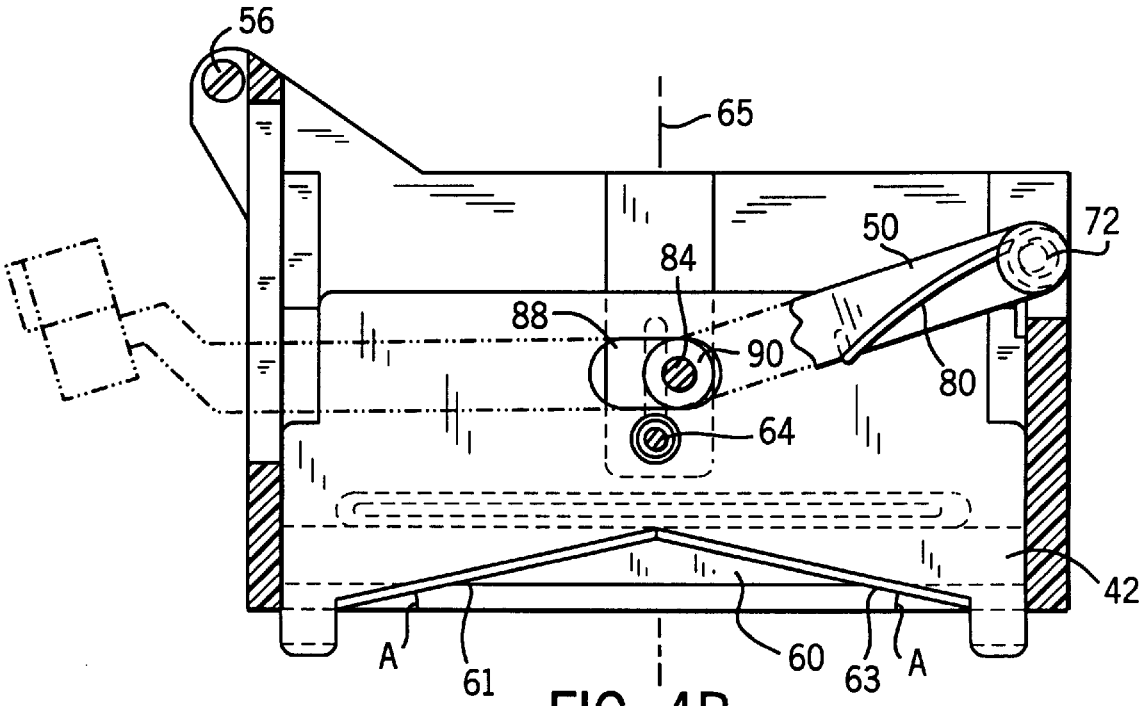
FIG. 4B is a plan view of the cutting mechanism in FIG. 4A in an actuated position.
Figure 5:
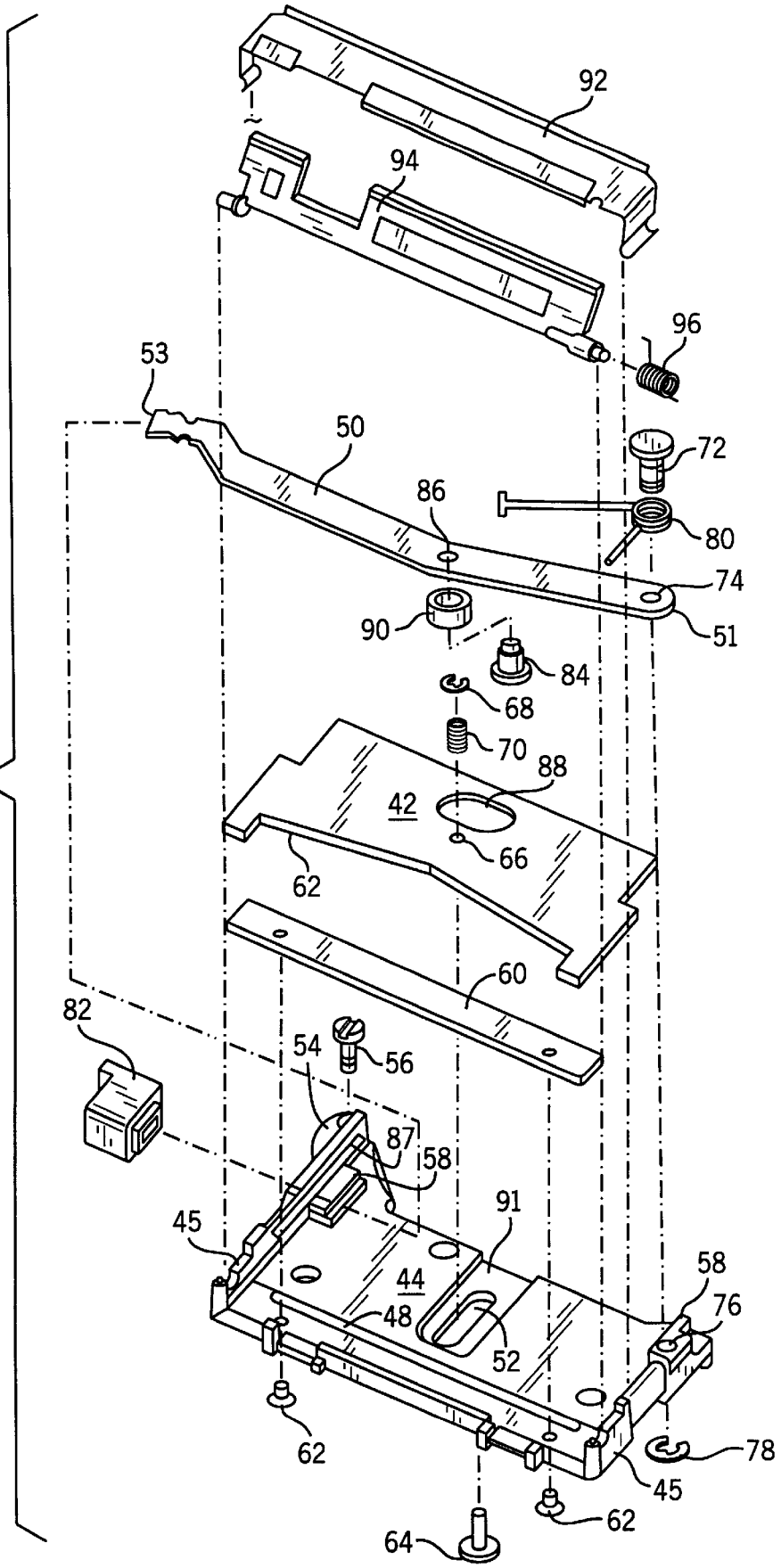
FIG. 5 is an exploded perspective view of the cutting mechanism in FIGS. 4A and 4B.

As shown in FIGS. 4A, 4B, and 5, the blade 42 disposed within the cutting mechanism 40 is slidably mounted on a base 44. The generally rectangular base 44 is preferably formed from die cast aluminum and has a pair of opposing sidewalls 45. A transverse slot 48 is formed in the base 44 and it extends substantially the entire width of the base 44 to allow labeling media 22 having a width up to 2.25" to pass through into the path of the blade 42. A single flange 54 integrally formed as part of the base 44 serves as a screw boss for mounting the cutter mechanism 40 to the printer 10 with a screw 56. Guide blocks 58, also integrally formed as part of the base 44, guide the blade 42 along a cutting axis 65.

A hardened steel breaker bar 60 is mounted forwardly of the transverse slot 48 and it cooperates with the blade 42 to define a cutting plane along the rearward edge of the breaker bar 60. A defined cutting plane ensures that the labeling media 22 is cleanly cut. The breaker bar 60 is preferably mounted to the base 44 by screws 62 which are threadably inserted into the bar 60 through the base 44.

As shown in FIGS. 4B and 5, the metal blade 42 has a chevron shaped cutting edge 62 that provides an optimum cutting angle A of 9 degrees while minimizing the blade 42 movement required to cut the labeling media 22. Although a cutting angle A of 9 to 12 degrees is preferred, any angle can be used with a resulting increase or decrease in required blade 42 movement to cut the labeling media 22.

The chevron shaped blade 42 provides two points of contact 61, 63 between the blade 42 and breaker bar 60 at any point during the blade 42 cutting movement, thus cutting the labeling media 22 from the labeling media edges toward its center in a single movement of the blade 42. The two points of contact 61, 63 between the blade 42 and breaker bar 60 minimizes the blade 42 movement along the cutting axis 65 necessary for a complete cut.

The blade 42 is slidably mounted to the base 44 for forwardly and rearwardly movement along the cutting axis 65 by a pin 64 that extends through a longitudinal slot 52 in the base 44 and a hole 66 generally centrally located in the blade 42. The longitudinal slot 52 formed in the base 44 rearward of the transverse slot 48 allows slidable movement of the blade 42 in the forwardly and rearwardly directions.

An E-ring 68 snapped on the end of the pin 64 tensions a helical spring 70 that vertically biases the blade in the direction of the breaker bar 60. The force exerted on the blade 42 by the spring 70 ensures consistent pressure between the blade 42 and breaker bar 60 at both points of contact 61, 63, thus allowing looser "fit" manufacturing tolerances for the cutter mechanism 40.

The lever stroke necessary to cut the labeling media 22 is minimized by pivotally mounting the lever 50 to the base 44 and pivotally and slidably mounting the lever 50 to the blade 42, thus providing a compact cutter mechanism 40. The lever 50 is pivotally mounted at one end 51 to the base 44 by a pin 72 extending through a hole 74 in the end 51 of the lever 50 and a hole 76 formed in the base 44.

An E-ring 78 snapped into place at the end of the pin 72 retains the pin 72 and a return spring 80 slidably mounted on the pin 72. The return spring 80 urges the lever 50 rearward toward the noncutting position, shown in FIG. 4A, after pivoting about the pin 72 to cut labeling media 22. The other end 53 of the lever 50 has a plastic cap 82 formed for engagement by an operator finger.

The lever 50 is pivotally and slidably mounted to the blade 42 by a pin 84 slidably inserted through a hole 86 in the lever 50 and a transverse slot 88 formed in the blade 42. The location of the hole 86 along the lever 50 defines the arc distance the lever 50 must pivot about pin 72 to slidably move the blade 42 along the cutting axis 65 to the actuated position. The lever extends through a slot 87 in the base sidewall 45 opposite the lever pivot point, thus limiting the arc distance and further defining the location of the hole 86.

A generally cylindrical roller 90 in the slot 88 receives the pin 84. The roller 90 rotates about the pin 84 and slidably moves transversely in the blade slot 88 to allow rearward and forward movement of the blade 42 without the blade 42 pivoting about a point.

Clearance slots formed in the base 44 prevent the mechanism 40 from binding by providing clearance for the heads of pins 64 and 84. A longitudinal clearance slot 91 formed in the base 44 receives the head of pin 84. A second longitudinal clearance slot 93 formed in the base side opposite slot 91 provides clearance for the head of pin 64. The clearance slots allow slidable movement of the pins 64 and 84 without interfering with other components of the mechanism 40 or printer 10.

A cutter cover 92 releasably mounted to the base sidewalls 45 protects the blade 42 and in cooperation with a cutter flapper 94, guides the labeling media 22 through the opening 16 in the printer housing 2. The generally rectangular shaped cutter flapper 94 is pivotally mounted to the base sidewalls 45 and adjacent to the cutter cover 92.

A spring 96 at one end of the flapper 94, urges the flapper 94 toward the cutter cover 92, thus guiding the labeling media 22 through the opening 16 in the housing 2. Advantageously, the flapper 94, urged by the spring 92, also holds the cut label in place until the user retrieves it for use, thus preventing the cut label from falling back into the printer.

While there has been shown and described what are at present considered the preferred embodiment of the invention, it will be obvious to those skilled in the art that various changes and modifications can be made therein without departing from the scope of the invention defined by the appended claims.

We claim:

1. A hand held label printer comprising:

a housing having a labeling media path disposed therein;

a printing mechanism disposed along said labeling media path; and a cutting mechanism disposed at an end of said labeling media path, said cutting mechanism including:

a base;

a blade mounted to said base for sliding motion along a cutting plane; and a lever having one end for engagement by a user, and being slidably coupled to said blade and pivotally mounted to said base, such that pivotal movement of said lever from a noncutting position to an actuated position slidably moves the coupling in a transverse direction to translate said blade along the cutting plane through a labeling media in said labeling path, thus cutting said labeling media; and a flapper pivotally mounted to said base, said flapper being urged against a surface for holding a cut label.

2. The hand held printer as in claim 1, in which said flapper is urged against a surface of a cutter cover disposed adjacent said flapper.

3. The hand held printer as in claim 1, including a spring which urges said flapper against a surface for holding a cut label between said flapper and the surface.

* * * * *